US010569549B2

(12) United States Patent
Yoshikawa

(10) Patent No.: US 10,569,549 B2
(45) Date of Patent: Feb. 25, 2020

(54) PRINTING APPARATUS AND PRINTING METHOD

(71) Applicant: SEIKO EPSON CORPORATION, Tokyo (JP)

(72) Inventor: Eishin Yoshikawa, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/247,976

(22) Filed: Jan. 15, 2019

(65) Prior Publication Data

US 2019/0217615 A1 Jul. 18, 2019

(30) Foreign Application Priority Data

Jan. 16, 2018 (JP) ..... 2018-004691

(51) Int. Cl.

| | |
|---|---|
| ***B41J 2/21*** | (2006.01) |
| ***B41J 2/15*** | (2006.01) |
| ***B41J 2/045*** | (2006.01) |
| ***B41J 2/175*** | (2006.01) |

(52) U.S. Cl.

CPC ..... *B41J 2/15* (2013.01); *B41J 2/04581* (2013.01); *B41J 2/175* (2013.01); *B41J 2/2107* (2013.01)

(58) Field of Classification Search

USPC ..... 347/43, 100, 101

See application file for complete search history.

(56) References Cited

U.S. PATENT DOCUMENTS 6,089,697 A * 7/2000 Tajika ..... B41J 2/14056 347/43

6,533,409 B2 * 3/2003 Koitabashi ..... B41J 2/2114 347/101

(Continued)

FOREIGN PATENT DOCUMENTS

JP 2000-190480 A 7/2000

JP 2015-189110 A1 11/2015

*Primary Examiner* — Lam S Nguyen

(74) *Attorney, Agent, or Firm* — Foley & Lardner LLP

(57) ABSTRACT

A printing apparatus configured to print an image on a medium includes a head having a first nozzle group configured to discharge a first liquid onto a medium, and a second nozzle group configured to discharge a second liquid acting on the first liquid, a main scanning unit configured to move the head in a main scanning direction, a sub scanning unit configured to move the medium in a sub scanning direction, and a control section configured to control discharging of the first liquid and discharging of the second liquid, and in the printing apparatus, the second nozzle group includes an upstream unit disposed on an upstream side of the first nozzle group in the sub scanning direction, and an overlapping unit located on a downstream side of the upstream unit in the sub scanning direction and disposed to overlap with at least a portion of the first nozzle group as viewed in the main scanning direction, the control section determines, based on liquid volume of the first liquid to be discharged, liquid volume of the second liquid to be discharged, and in a case where the liquid volume determined of the second liquid is equal to or less than a threshold value, the control section makes, of the overlapping unit and the upstream unit, at least the overlapping unit discharge the second liquid.

5 Claims, 8 Drawing Sheets

(56) References Cited

U.S. PATENT DOCUMENTS

| | | | | |
|---|---|---|---|---|
| 8,506,049 | B2 * | 8/2013 | Kakutani | B41J 2/2117<br>347/43 |
| 8,529,043 | B2 * | 9/2013 | Kakutani | B41J 2/14201<br>347/100 |
| 2002/0196303 | A1 | 12/2002 | Koitabashi et al. | |
| 2006/0158481 | A1 * | 7/2006 | Spevak | B41J 2/2114<br>347/43 |

* cited by examiner

PRINTING APPARATUS AND PRINTING METHOD

BACKGROUND

1. Technical Field

The invention relates to a printing apparatus.

2. Related Art

Traditionally, a printing apparatus configured to perform printing by using ink and a reaction liquid acting on the ink has been known. For example, a printing apparatus described in JP-A-2000-190480 includes a configuration where a print mode in which printing is performed by using ink and a reaction liquid agglutinating a color material of the ink, and a printing mode in which printing is performed by using the ink only without using such a reaction liquid can be selected.

However, in the printing apparatus described in JP-A-2000-190480, whether the reaction liquid is used in combination can only be selected according to a type of a printing medium. Thus, used volume of the reaction liquid, timing of usage, or the like for performing appropriate printing for each of various media has not been considered at all. Such an issue is common to, not only the case in which the reaction liquid agglutinating the color material is used, but also to a case in which any liquid acting on ink is used. Additionally, the issue is common to a printing apparatus configured to discharge not only ink but also any liquid. Thus, there is room for improvement to perform appropriate printing on various media by using a liquid and another liquid acting on such a liquid.

SUMMARY

The invention has been made to address at least some of the above-described issues and can be realized as the following modes.

(1) According to a mode of the invention, a printing apparatus is provided. This printing apparatus is a printing apparatus configured to print an image on a medium and includes a head having a first nozzle group configured to discharge a first liquid onto the medium, and a second nozzle group configured to discharge a second liquid acting on the first liquid, a main scanning unit configured to relatively move the head in a main scanning direction with respect to the medium, a sub scanning unit configured to relatively move the medium in a sub scanning direction intersecting the main scanning direction with respect to the head, and a control section configured to control discharging of the first liquid from the first nozzle group and discharging of the second liquid from the second nozzle group, and in the printing apparatus, the second nozzle group includes an upstream unit disposed on an upstream side of the first nozzle group in the sub scanning direction, and an overlapping unit located on a downstream side of the upstream unit in the sub scanning direction and disposed to overlap with at least a portion of the first nozzle group as viewed in the main scanning direction, the control section determines, based on liquid volume of the first liquid to be discharged, liquid volume of the second liquid to be discharged, and in a case where the liquid volume determined of the second liquid is equal to or less than a threshold value, the control section makes, of the overlapping unit and the upstream unit, at least the overlapping unit discharge the second liquid. According to the printing apparatus of this mode, since in a case where required liquid volume is equal to or less than the threshold value, the second liquid is discharged from at least the overlapping unit, the second liquid and the first liquid can be discharged simultaneously, and the second liquid and the first liquid can be caused to permeate into the medium simultaneously. Thus, a case where the second liquid discharged in advance excessively permeates into the medium in advance, and cannot act on the first liquid subsequently discharged can be suppressed. Accordingly, printing using a liquid (first liquid) and the other liquid (second liquid) acting on the liquid can be optimized with respect to various media. Thus, types of applicable media can be increased.

(2) In the printing apparatus of the above-described mode, in a case where the liquid volume determined of the second liquid exceeds the threshold value, the control section may make both the overlapping unit and the upstream unit discharge the second liquid. According to the printing apparatus of this mode, since in a case where required liquid volume is equal to or less than the threshold value, the reaction liquid is discharged from both the overlapping unit and the upstream unit, discharging of the second liquid by volume exceeding the threshold value volume from the overlapping unit can be suppressed, and insufficient drying of a portion of the medium onto which the second liquid and the first liquid are simultaneously discharged can be suppressed. Additionally, shortage of the liquid volume of the second liquid with respect to the liquid volume of the first liquid can be suppressed and a decrease in image quality can be suppressed.

(3) In the printing apparatus of the above-described mode, the control section may include a medium type acquisition unit configured to acquire information about a type of the medium, and may determine liquid volume of the second liquid to be discharged from the upstream unit according to a type of the medium. According to the printing apparatus of the above-described mode, since the control section determines the liquid volume of the second liquid to be discharged from the upstream unit according to the type of the medium, printing can further be optimized with respect to various media. Additionally, as compared to an aspect in which a user selects to increase/decrease liquid volume of a reaction liquid, the operation by the user can be omitted.

(4) In the printing apparatus of the above-described mode, the threshold value may be set for each of a plurality of print modes different in printing quality from one another. According to the printing apparatus of this mode, since the threshold value is set for each of the plurality of print modes different in printing quality from one another, the threshold value can be optimized for each print mode to optimize printing.

The invention can be realized in various modes other than a printing apparatus. For example, the invention can be realized in modes including a printing method, a computer program for realizing the printing method, and a recording medium on which the computer program is recorded.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Exemplary Embodiment

Figure 1:
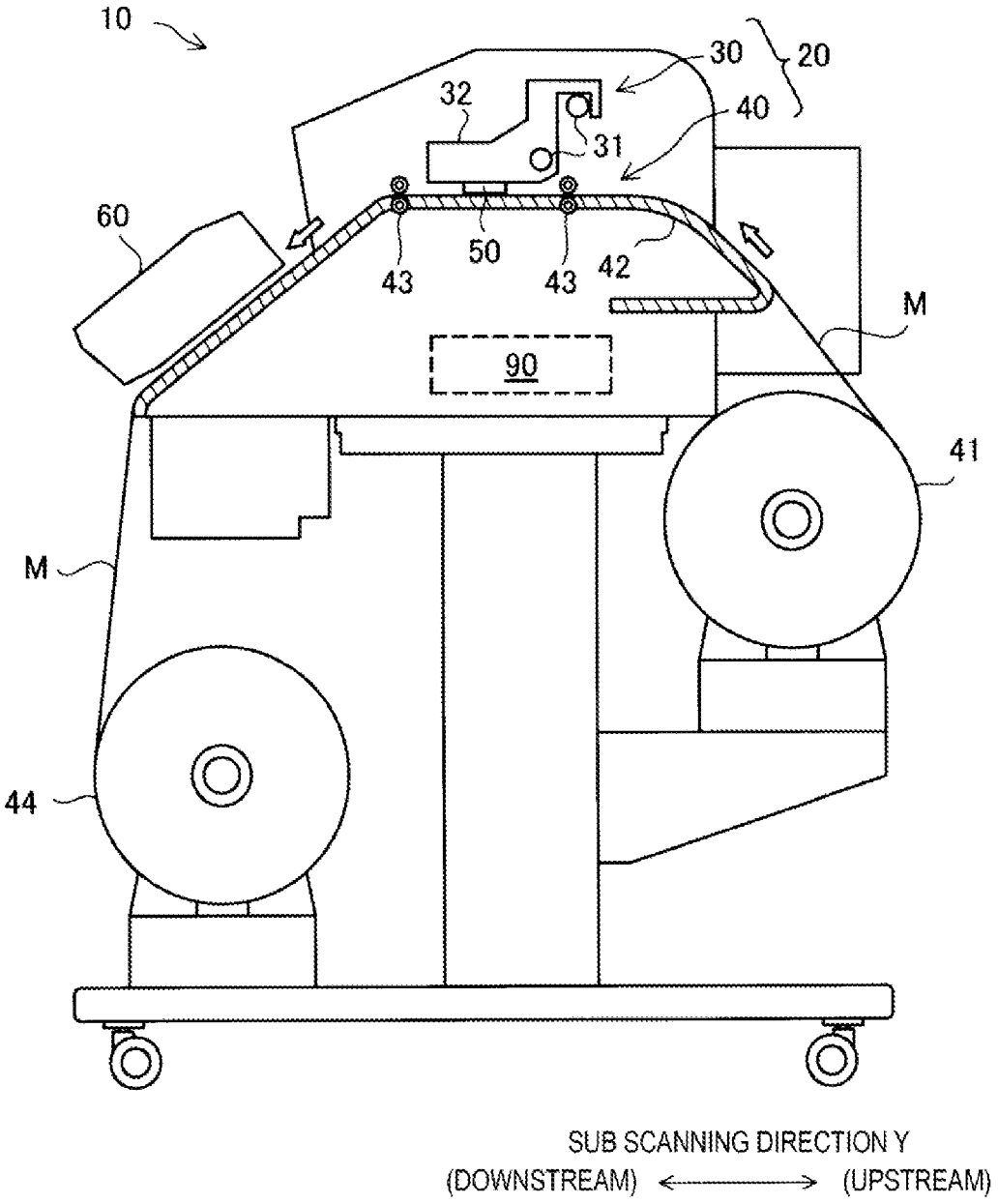
FIG. 1 is an explanatory view illustrating a schematic configuration of a printing apparatus.
Figure 2:
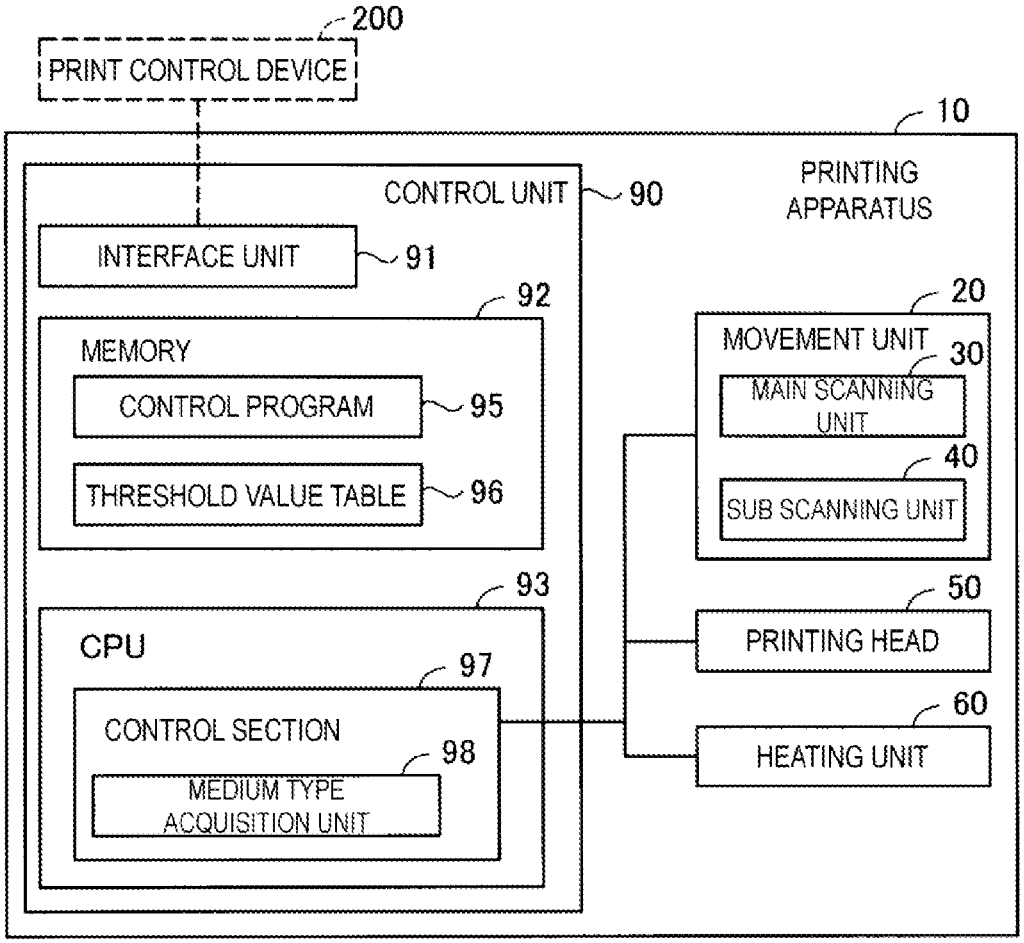
FIG. 2 is a block diagram illustrating a schematic configuration of the printing apparatus.

A-1. Device Configuration:

FIG. 1 is an explanatory view illustrating a schematic configuration of a printing apparatus 10 as an exemplary embodiment of the invention. FIG. 2 is a block diagram illustrating a schematic configuration of the printing apparatus 10. In FIG. 1, a sub scanning direction Y is denoted by a solid arrow. The sub scanning direction Y is a direction perpendicular to a main scanning direction X illustrated in FIG. 3 described later. The main scanning direction X is a direction perpendicular to a paper surface of FIG. 1. Note that the sub scanning direction Y and the main scanning direction X may not necessarily be perpendicular to each other, and may be directions intersecting each other at any angle.

The printing apparatus 10 prints an image on a medium M based on print data input from a print control device 200 illustrated in FIG. 2. In the exemplary embodiment, the print control device 200 includes a personal computer in which driver software for the printing apparatus 10 is installed. The print control device 200 includes an unillustrated drive capable of reading a recording medium such as a hard disk drive, a CD-ROM and a memory card. In the print control device 200, print data is generated and the print data is transmitted to the printing apparatus 10. Note that, transmission of the print data may be executed via any type of a communication network such as a Universal Serial Bus (USB), a wireless Local Area Network (LAN), and a wired LAN.

The printing apparatus 10 is configured as a so-called serial type ink jet printer. The printing apparatus 10 discharges ink of four colors of cyan (C), magenta (M), yellow (Y), and black (K), and a reaction liquid to form dots on the medium M and print an image. Note that in addition to the ink of the four colors, ink such as light cyan or light magenta may be used, and any other type of ink may be used. Additionally, the medium M in the exemplary embodiment includes a resin material, but may include any other printing medium such as paper and fabric instead of the resin material.

The reaction liquid acts on the ink to express characteristics other than color development of the reaction liquid. In the exemplary embodiment, the reaction liquid includes liquid containing no color material, and includes a function to improve color development of ink. Note that the reaction liquid may include any other function such as a function to suppress agglutination of a color material incorporated in ink, and a function to enhance fixation of ink, and may include any liquid acting on ink.

The printing apparatus 10 includes a movement unit 20, a printing head 50, a heating unit 60, and a control unit 90.

The movement unit 20 executes movement of the medium M and the printing head 50 to print an image on the medium M. The movement unit 20 includes a sub scanning unit 40 and a main scanning unit 30. The sub scanning unit 40 transports the medium M in a transport direction denoted by a white arrow to pass the medium M in a vicinity of the printing head 50 and a vicinity of the heating unit 60. The transport direction of the medium M in passing the vicinity of the printing head 50 corresponds to the sub scanning direction Y. As illustrated in FIG. 1, the sub scanning unit 40 includes a feeding unit 41, a support unit 42, a plurality of transport rollers 43, and a winding unit 44. The feeding unit 41 rotates and feeds the medium M wound in a roll shape and to be subjected to printing, with an unillustrated driving motor. The support unit 42 supports the medium M being transported in the transport direction. The plurality of transport rollers 43 is rotated by the unillustrated driving motor, and transports the medium M on the support unit 42 in the transport direction. The winding unit 44 winds the medium M having been subjected to printing.

The main scanning unit 30 moves the printing head 50 in the main scanning direction X with respect to the medium M. The main scanning unit 30 includes a guide shaft 31 and a carriage 32. The guide shaft 31 includes two stick-shaped members, and has a longitudinal direction disposed in parallel with the main scanning direction X. The guide shaft 31 supports the carriage 32 to be movable. The carriage 32 is driven by an unillustrated carriage motor, and reciprocates along the guide shaft 31 in the main scanning direction X.

The printing head 50 is mounted on the carriage 32 and faces the medium M. Thus, the printing head 50 reciprocates in the main scanning direction X, along with reciprocating action of the carriage 32. Note that the movement in the main scanning direction X of the printing head 50 is also referred to as "main scanning" and a "pass", and one time of the main scanning is also referred to as a "main scanning pass". In the printing head 50, on a surface facing the medium M, a plurality of nozzles configured to discharge the ink and the reaction liquid is formed.

Figure 3:
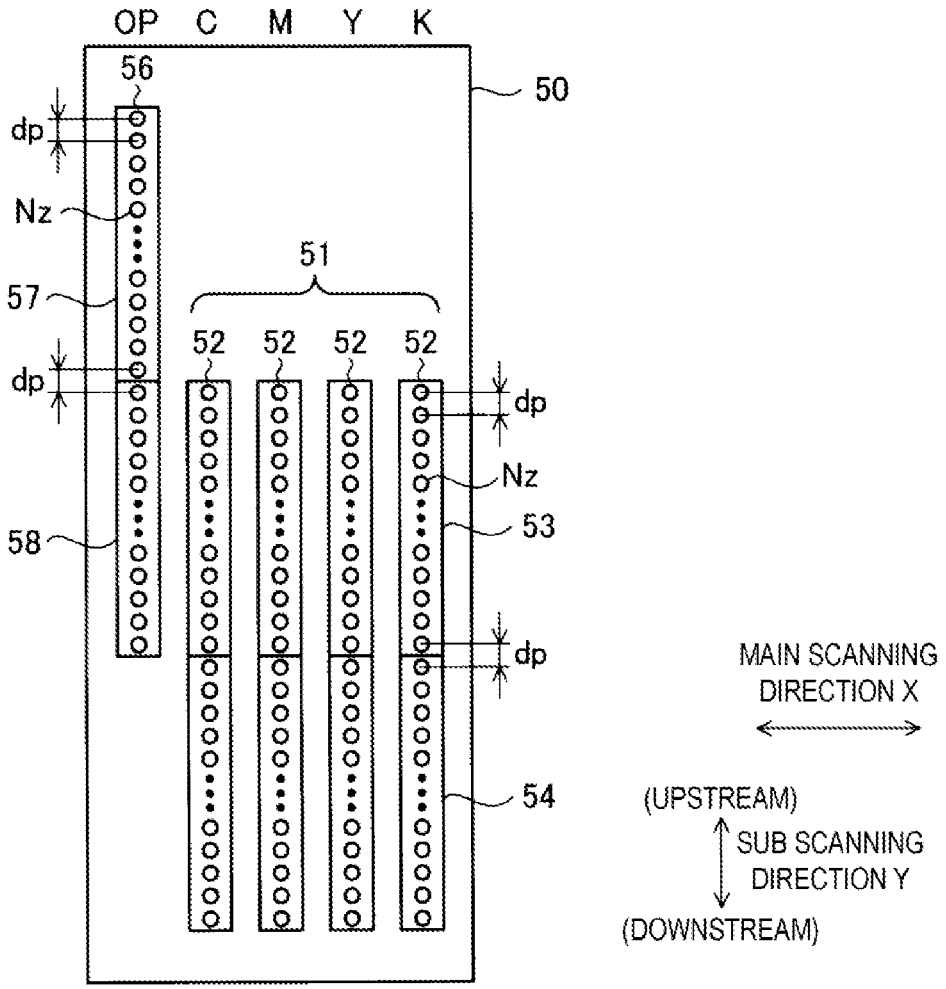
FIG. 3 is an explanatory view illustrating a disposition configuration of nozzles provided in a printing head.

FIG. 3 is an explanatory view illustrating a disposition configuration of the nozzles provided in the printing head 50. In FIG. 3, a configuration of the printing head 50 as viewed from the medium M side is illustrated. The printing head 50 includes a first nozzle group 51 configured to discharge the ink of the respective colors (C, M, Y, K), and a second nozzle group 56 configured to discharge the reaction liquid.

The first nozzle group 51 includes four nozzle rows 52 corresponding to the respective colors disposed in parallel with the sub scanning direction Y. Each of the nozzle rows 52 is formed of a first nozzle chip 53 and a second nozzle chip 54 arranged in the sub scanning direction Y. The first nozzle chip 53 is located on an upstream side of the second nozzle chip 54. On each of the nozzle chips 53 and 54, a nozzle row including a plurality of nozzles Nz arranged in the sub scanning direction Y at a predetermined nozzle pitch dp is formed.

The second nozzle group 56 is formed of an upstream unit 57 and an overlapping unit 58 being two nozzle chips arranged in the sub scanning direction Y. The upstream unit 57 is disposed on an upstream side of the first nozzle group 51 in the sub scanning direction Y. The overlapping unit 58 is arranged and disposed on a downstream side of the upstream unit 57 in the sub scanning direction Y, and is disposed to overlap with the second nozzle chip 54 as viewed in the main scanning direction X. On each of the upstream unit 57 and the overlapping unit 58, a nozzle row including the plurality of nozzles Nz arranged in the sub scanning direction Y at the predetermined nozzle pitch dp is formed.

In the following description, each of the first nozzle chip 53, the second nozzle chip 54, the upstream unit 57 and the overlapping unit 58 is also simply referred to as a "nozzle chip". The "nozzle chip" means a component manufactured by integrating structures for discharging ink, for example, the nozzles Nz, a piezoelectric element, and an ink chamber by a semiconductor manufacturing technology (so-called MEMS).

A length along the sub scanning direction Y of each nozzle chip is equal to a length corresponding to a transport amount of the medium M in one time of the sub scanning. Note that the length along the sub scanning direction Y of each nozzle chip may be greater than a length corresponding to the transport amount of the medium M in one time of the sub scanning. In the exemplary embodiment, "one time of the sub scanning" means movement of the medium M transported during two consecutive main scanning passes.

An interval between a nozzle Nz at an end on a downstream side in the sub scanning direction Y of the first nozzle chip 53 and a nozzle Nz at an end on the upstream side in the sub scanning direction Y of the second nozzle chip 54 is equal to the nozzle pitch dp at each nozzle chip. Additionally, an interval between a nozzle Nz on an end on the downstream side in the sub scanning direction Y of the upstream unit 57 and a nozzle Nz on an end on an upstream side in the sub scanning direction Y of the overlapping unit 58 is equal to the nozzle pitch dp at each nozzle chip. In the exemplary embodiment, on each nozzle chip, 200 nozzles Nz are formed, but some of the nozzles Nz are omitted in an illustration in FIG. 3. Note that the number of the nozzles Nz formed on each nozzle chip may be any other number. On each nozzle Nz, an ink chamber and a piezoelectric element (not illustrated) are provided, and driving of the piezoelectric element expands and contracts the ink chamber to discharge an ink droplet or a reaction liquid droplet from each nozzle Nz. Note that instead of a piezoelectric method using the piezoelectric element, a method for discharging a droplet may be any other method such as a thermal method.

Control of discharging of the ink from the first nozzle group 51 and discharging of the reaction liquid from the second nozzle group 56 will be described later.

As illustrated in FIG. 1, the heating unit 60 is disposed on a downstream side of the printing head 50 in the transport direction of the medium M. The heating unit 60 heats the medium M having passed through the printing head 50, and evaporates and dries solvent components of the ink and the reaction liquid on the medium M.

The heating unit 60 includes an unillustrated heating element inside, and blows heated air and radiates infrared rays to heat the medium M. Note that one of the blow of the heated air and the radiation of the infrared rays may be omitted, and a heating device employing any other method may be used as the heating unit 60. Additionally, a length along the main scanning direction X of the heating unit 60 may be identical to a length along the main scanning direction X of the medium M, or may be greater than the length along the main scanning direction X of the medium M.

The control unit 90 illustrated in FIG. 2 performs overall control of the printing apparatus 10. The control unit 90 includes a microcomputer, and includes an interface unit 91, a memory 92, and a CPU 93.

The interface unit 91 performs transmission and reception of print data and the like to and from the print control device 200. The memory 92 includes a recording medium such as a RAM, a ROM, and an EEPROM, and stores a control program 95 configured to control an operation of the printing apparatus 10, and a threshold value table 96. The threshold value table 96 will be described later in detail. The CPU 93 decompresses and executes the control program 95 to function as a control section 97.

The control section 97 integrally controls printing based on print data input from the print control device 200. The control section 97 controls the discharging of the ink from the first nozzle group 51 and the discharging of the reaction liquid from the second nozzle group 56. The control section 97 generates signals for driving the first nozzle group 51 and the second nozzle group 56 and transmits the signals to the printing head 50. Additionally, the control section 97 controls the sub scanning unit 40 to transport the medium M, controls the main scanning unit 30 to perform reciprocating action of the carriage 32, and controls the heating unit 60 to perform heating. Further, the control section 97 includes a medium type acquisition unit 98. The medium type acquisition unit 98 acquires information about a type of the medium M such as quality of materials and a composition, from print data transmitted from the print control device 200. Such information is set in the print control device 200 by a user in advance.

According to the above-described configuration, the printing apparatus 10 repeats a pass operation in which the main scanning unit 30 reciprocates the print head 50 in the main scanning direction X and the ink and the reaction liquid are discharged from the printing head 50, and a transport operation in which the sub scanning unit 40 moves the medium M in the sub scanning direction Y, and prints an image on the medium M.

In the exemplary embodiment, the ink corresponds to a subordinate concept of the first liquid described in the summary, the reaction liquid corresponds to a subordinate concept of the second liquid described in the summary, and the printing head 50 corresponds to a subordinate concept of the head described in the summary.

Figure 4:
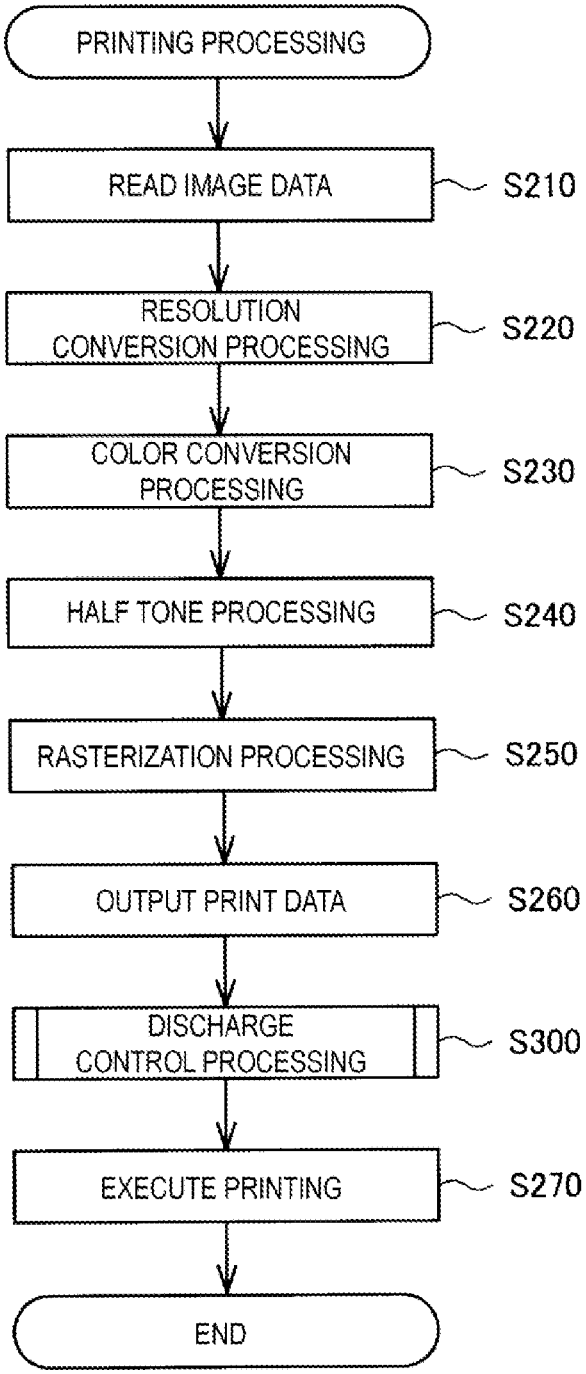
FIG. 4 is a flowchart illustrating a procedure of printing processing.

A-2. Printing Processing:

FIG. 4 is a flowchart illustrating a procedure of printing processing. When in the print control device 200, a user specifies an image to print and instructs to execute printing, printing processing is executed in the print control device 200 and the printing apparatus 10.

The print control device 200 reads image data of the image specified by the user (step S210). At step 210, for example, the image data stored in a recording medium such as a hard disk drive, a CD-ROM and a memory card is read. The image data includes gradation values (0 to 255) of respective color components of red (R), green (G), and blue (B).

The print control device 200 executes resolution conversion processing of the read image data (step S220). Specifically, the print control device 200 converts resolution of the image data to resolution used when printing is performed on the medium M.

The print control device 200 executes color conversion processing (step S230). Specifically, the print control device 200 refers to an unillustrated color conversion table stored in an unillustrated memory, to convert RGB data to CMYK data of 256 gradations expressed by a color space of ink colors CMYK of the printing apparatus 10.

The print control device 200 executes half tone processing (step S240). Specifically, the print control device 200 refers to an unillustrated dither mask or the like stored in an unillustrated memory, to generate dot data obtained by converting gradation values of 256 gradations of the CMYK data into gradation values of four stages (2 bit data) that can be expressed in the printing apparatus 10. The four stages mean four stages expressed by using one of two types of dots different in size (a large dot and a small dot), by using the two types of dots in combination, and by using none of the two types of dots.

The print control device 200 executes rasterization processing (step S250). Specifically, the print control device 200 divides the dot data generated in the half tone processing into dot data for each main scanning pass.

The print control device 200 adds a printing control command to the data obtained after the rasterization processing (hereinafter, also referred to as "raster data"), generates print data, and outputs the print data to the printing apparatus 10 (step S260). The printing control command includes, for example, information about a type of the medium M, transport data about a transport amount in the sub scanning direction Y and speed of the medium M in one time of the sub scanning, and the like. Note that the information about the type of the medium M may be output to the printing apparatus 10 separately from the printing control command.

The control section 97 of the printing apparatus 10 executes discharge control processing, based on the output print data (step S300).

Figure 5:
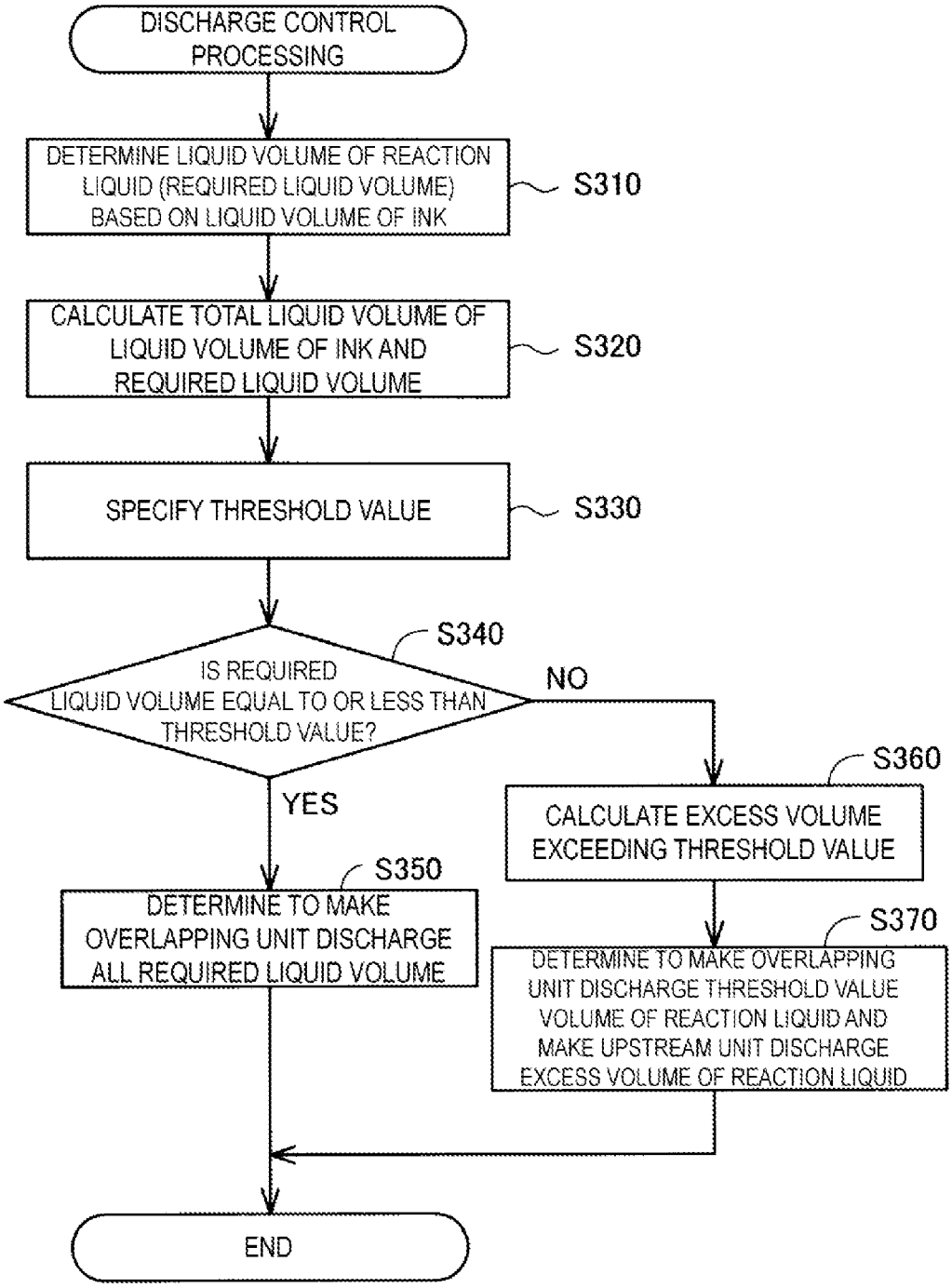
FIG. 5 is a flowchart illustrating a procedure of discharge control processing.

FIG. 5 is a flowchart illustrating a procedure of the discharge control processing. The control section 97 calculates, based on the raster data, liquid volume of ink to be discharged from the first nozzle group 51, and determines, based on the calculated liquid volume of the ink, liquid volume of the reaction liquid to be discharged from the second nozzle group 56 (hereinafter, also referred to as "required liquid volume") (step S310). In the following description, unless otherwise noted, liquid volume of ink means total volume obtained by totaling liquid volume of ink of respective colors. The required liquid volume is proportional to the liquid volume of the ink. Thus, the control section 97 can calculate and determine the required liquid volume from the liquid volume of the ink. Additionally, the control section 97 may determine the required liquid volume by referring to a table associated with liquid volume of ink in advance. In such a table, for example, the required liquid volume may be set to volume appropriate according to a type of the reaction liquid, a type of the ink, a type of the medium M, and the like.

The control section 97 totals the liquid volume of the ink to be discharged from the first nozzle group 51 and the required liquid volume determined at step S310, to calculate total liquid volume (step S320). The control section 97 specifies a threshold value for the liquid volume of the reaction liquid to be discharged from the second nozzle group 56 (step S330). At step S330, the control section 97 refers to the threshold value table 96 created and stored in the memory 92 in advance, to specify the threshold value. Note that instead of referring to the threshold value table 96 and specifying the predetermined threshold value, the control section 97 may calculate and specify a threshold value, based on a transport amount in the sub scanning direction Y of the medium M in one time of the sub scanning, and the like.

Figure 6:
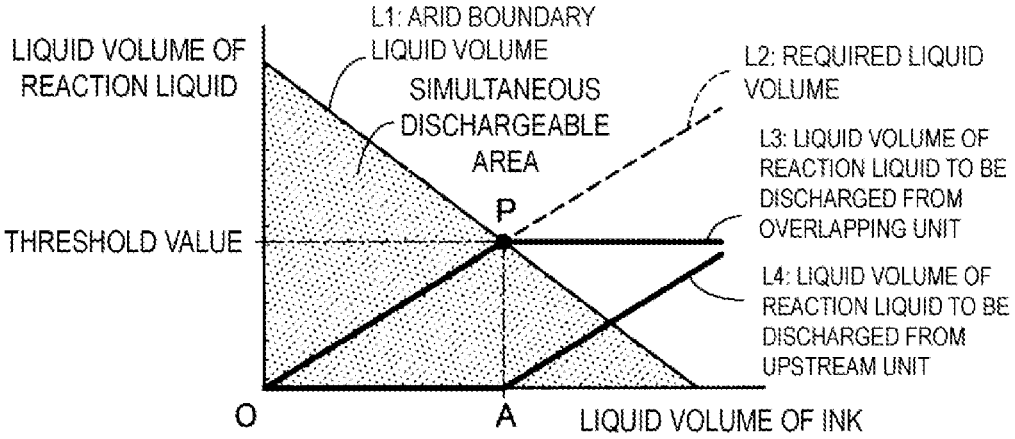
FIG. 6 is an explanatory view for explaining threshold values and discharge control processing results.

FIG. 6 is an explanatory view for explaining threshold values and discharge control processing results. In FIG. 6, a vertical axis indicates liquid volume of the reaction liquid, and a horizontal axis indicates liquid volume of the ink to be discharged from the first nozzle group 51 in the main scanning pass. Additionally, a straight line L1 indicates arid boundary liquid volume, a straight line L2 denoted by a broken line indicates the required liquid volume, a line L3 denoted by a bold line indicates liquid volume of the reaction liquid to be discharged from the overlapping unit 58, and a line L4 denoted by a bold line indicates liquid volume of the reaction liquid to be discharged from the upstream unit 57. Note that both the straight line L2 and the line L3 extend from an origin O, and respective portions of the straight line L2 and the line L3 overlap with each other. Additionally, in FIG. 6, an area surrounded by the vertical axis, the horizontal axis, and the straight line L1 is hatched and illustrated as a simultaneous dischargeable area.

The arid boundary liquid volume is liquid volume defined under a condition in which discharged liquid can be dried sufficiently, and means maximum liquid volume dischargeable in the main scanning pass. Such liquid volume is a total value of the liquid volume of the ink and the liquid volume of the reaction liquid. The ink and the reaction liquid discharged from the printing head 50 onto the medium M are heated and dried in the heating unit 60 disposed on a downstream side in the transport direction. Here, time during which the ink and the reaction liquid discharged in the main scanning pass are heated in the heating unit 60 is fixed time based on transport time of the medium M in one time of the sub scanning. Thus, when the total value of the liquid volume of the ink and the liquid volume of the reaction liquid is too large, the drying in the heating unit 60 may be insufficient. Accordingly, in the printing apparatus 10, the arid boundary liquid volume is set in advance. The arid boundary liquid volume is set according to a transport amount in the sub scanning direction Y of the medium M in one time of the sub scanning, transport speed, a heating condition in the heating unit 60, and the like. To make the total value of the liquid volume of the ink and the liquid volume of the reaction liquid equal to or less than the arid boundary liquid volume, the liquid volume of the reaction liquid discharged simultaneously in the main scanning pass identical to the main scanning pass in which the ink is discharged is set to fall within the simultaneous dischargeable area.

A threshold value of the liquid volume of the reaction liquid to be discharged from the second nozzle group 56 is set as the liquid volume of the reaction liquid corresponding to an intersection point P of the straight line L1 of the arid boundary liquid volume and the straight line L2 of the required liquid volume. In other words, the threshold value is set as a maximum value of the required liquid volume of the reaction liquid within the simultaneous dischargeable area. The threshold value is predetermined for each of a plurality of print modes different in printing quality from one another, and according to the transport amount of the medium M in one time of the sub scanning, image quality, the number of times of scanning, the number of reprints, and the like. Note that the threshold value may be calculated for each time and for each of the plurality of print modes. The line L3 and the line L4 illustrated in FIG. 6 will be described later in detail.

The control section 97 determines whether the required liquid volume determined at step S310 is equal to or less than the threshold value specified at step S330 (step S340). In a case where the required liquid volume is determined to be equal to or less than the threshold value (step S340: YES), the control section 97 determines to make, of the overlapping unit 58 and the upstream unit 57 provided in the second nozzle group 56, the overlapping unit 58 discharge all the required liquid volume (step S350). Following step S350, the discharge control processing ends and the processing returns to the printing processing illustrated in FIG. 4.

On the other hand, in a case where the required liquid volume is determined to be not equal to and not less than the threshold value, that is, in a case where the required liquid volume exceeds the threshold value (step S340: NO), the control section 97 calculates excess volume exceeding the threshold volume out of the required liquid volume (step S360). The control section 97 determines to make, of the overlapping unit 58 and the upstream unit 57 provided in the second nozzle group 56, the overlapping unit 58 discharge the threshold value volume of the reaction liquid, and make the upstream unit 57 discharge the excess volume of the reaction liquid (step S370). Following step S370, the discharge control processing ends and the processing returns to the printing processing illustrated in FIG. 4.

As a result of the discharge control processing, the required liquid volume denoted by the broken straight line L2 in FIG. 6 is divided into the liquid volume to be discharged from the overlapping unit 58 and denoted by the line L3, and the liquid volume to be discharged from the upstream unit 57 and denoted by the line L4.

When the liquid volume of the ink is equal to or less than liquid volume A corresponding to the intersection point P of the straight line L1 and the straight line L2, the required liquid volume is equal to or less than the threshold value. When the required liquid volume is equal to or less than the threshold value, the reaction liquid is to be discharged from the overlapping unit 58 only, and is not to be discharged from the upstream unit 57. Accordingly, discharged volume from the overlapping unit 58 increases in proportion to the liquid volume of the ink. As described above, when the required liquid volume is equal to or less than the threshold value, discharging from the overlapping unit 58 is executed in preference to discharging from the upstream unit 57 and the reaction liquid is to be discharged from the overlapping unit 58 only. A reason for this is as follows. To make the reaction liquid act on the ink, the reaction liquid is preferably discharged simultaneously with the ink. When the reaction liquid is discharged in advance and the ink is discharged after a while, the reaction liquid discharged in advance may excessively permeate into the medium M, and cannot act on the ink subsequently discharged. Accordingly, in the printing apparatus 10, the discharging from the overlapping unit 58 capable of discharging the reaction liquid simultaneously with the ink is executed in preference to the discharging from the upstream unit 57.

On the other hand, when the liquid volume of the ink exceeds the liquid volume A, the required liquid volume exceeds the threshold value. When the required liquid volume exceeds the threshold value, discharged volume from the overlapping unit 58 is set to be a fixed value being the threshold value, and discharged volume from the upstream unit 57 is set to increase in proportion to the liquid volume of the ink. As described above, when the required liquid volume exceeds the threshold value, the threshold value volume of the reaction liquid is to be discharged from the overlapping unit 58, and the excess volume of the reaction liquid is to be discharged from the upstream unit 57. A reason for this is as follows. The threshold value volume of the reaction liquid is discharged from overlapping unit 58 and accordingly, the reaction liquid and the ink can be discharged simultaneously within the range of the arid boundary liquid volume. Thus, since discharging of the reaction liquid by volume exceeding the threshold value volume from the overlapping unit 58 can be suppressed, insufficient drying in the heating unit 60 of a portion of the medium M onto which the reaction liquid and the ink are simultaneously discharged can be suppressed. In addition, as compared to a configuration in which the reaction liquid to be discharged from the overlapping unit 58 is reduced to be less than the threshold value volume, image quality can be made stable. Additionally, the excess volume of the upstream unit 57 is discharged from the upstream unit 57 and accordingly, the required liquid volume for the liquid volume of the ink can be fulfilled. Thus, shortage of the liquid volume of the reaction liquid with respect to the liquid volume of the ink can be suppressed and a decrease in image quality can be suppressed.

In the printing processing illustrated in FIG. 4, the control section 97 generates a driving signal based on results of the discharge control processing, controls the printing head 50 and the movement unit 20, makes the respective nozzle groups 51 and 56 of the printing head 50 discharge the reaction liquid and the ink, and executes printing (step S270).

When the required liquid volume is equal to or less than the threshold value, discharging of the reaction liquid from the upstream unit 57 is not performed, and in each main scanning pass, discharging of the ink from the first nozzle group 51 and discharging of the reaction liquid from the overlapping unit 58 are simultaneously performed. On the other hand, when the required liquid volume exceeds the threshold value, the excess volume of the reaction liquid is discharged from the upstream unit 57 in a first main scanning pass. In a second main scanning pass performed after transport of the medium M in the sub scanning direction Y, the ink is discharged from the first nozzle group 51, and the threshold value volume of the reaction liquid is discharged from the overlapping unit 58. As described above, in the two main scanning passes, the reaction liquid is discharged by volume necessary for the ink discharged from the first nozzle group 51. Note that the reaction liquid discharged from the upstream unit 57 in the first main scanning pass dries to some extent till time of the second main scanning pass. Thus, depending on the reaction liquid discharged from the upstream unit 57, the arid boundary liquid volume is not exceeded. In addition, at the second main scanning pass, the excess volume of the reaction liquid with respect to the ink to be discharged from the first nozzle group 51 in a third main scanning pass is discharged from the upstream unit 57. That is, at an n-th main scanning pass, the ink is discharged and the threshold value volume of the reaction liquid is also discharged from the overlapping unit 58, and the excess volume of the reaction liquid with respect to the ink to be discharged at an (n+1)-th main scanning pass is discharged from the upstream unit 57. Note that n is an integer equal to or greater than 1. The ink and the reaction liquid discharged onto the medium M are dried in the heating unit 60. The above-described processing is repeated to end the printing processing.

According to the printing apparatus 10 of the above-described exemplary embodiment, since in a case where the required liquid volume is equal to or less than the threshold value, the reaction liquid is discharged from the overlapping unit 58, the reaction liquid and the ink can be discharged simultaneously in an identical main scanning pass, and the reaction liquid and the ink can be caused to permeate into the medium M simultaneously. Thus, a case in which the reaction liquid discharged in advance excessively permeates into the medium M in advance, and cannot act on the ink subsequently discharged can be suppressed. Accordingly, printing using the ink and the reaction liquid acting on the ink can be optimized with respect to various media. Thus, types of applicable media can be increased.

On the other hand, when the required liquid volume exceeds the threshold value, the reaction liquid is discharged from both the overlapping unit 58 and the upstream unit 57. At this time, since the threshold value volume of the reaction liquid is discharged from the overlapping unit 58, and the excess volume of the reaction liquid is discharged in advance from the upstream unit 57, the reaction liquid and the ink can be discharged simultaneously within the range of the arid boundary liquid volume, and the required liquid volume can also be fulfilled. Thus, since discharging of the reaction liquid by volume exceeding the threshold value volume from the overlapping unit 58 can be suppressed, insufficient drying in the heating unit 60 of a portion of the medium M onto which the reaction liquid and the ink are simultaneously discharged can be suppressed. Additionally, shortage of the liquid volume of the reaction liquid with respect to the liquid volume of the ink can be suppressed and a decrease in image quality can be suppressed. Additionally, in a case where the required liquid volume exceeds the threshold value, the threshold value volume of the reaction liquid is discharged from the overlapping unit 58, and thus, as compared to a configuration in which the reaction liquid to be discharged from the overlapping unit 58 is reduced to be less than the threshold value, image quality can be made stable.

Additionally, since the threshold value is predetermined for each of the plurality of print modes different in printing quality from one another, the threshold value can be optimized for each print mode to optimize printing. Additionally, since the threshold value is specified with reference to the threshold value table 96 created in advance, calculation of the threshold value can be omitted, and an increase in a processing load of the control section 97 can be suppressed. Additionally, when permeation speed of the reaction liquid differs depending on the type of the medium M, the threshold value can be optimized according to the type of the medium M, and the printing can further be optimized with respect to the medium M. Additionally, since the excess volume of the reaction liquid is discharged from the upstream unit 57, liquid volume of the reaction liquid to be discharged simultaneously with the ink can be reduced. Thus, volume of the ink that can be discharged simultaneously with the reaction liquid under an identical drying condition can be increased relatively, and image quality can be improved. Additionally, since the reaction liquid is discharged from both the overlapping unit 58 and the upstream unit 57 in the main scanning pass, a nozzle area can be used effectively, nozzle usage efficiency of the upstream unit 57 can be improved, and shortening of a lifetime of the printing head 50 can be suppressed.

B. Second Exemplary Embodiment

Figure 7:
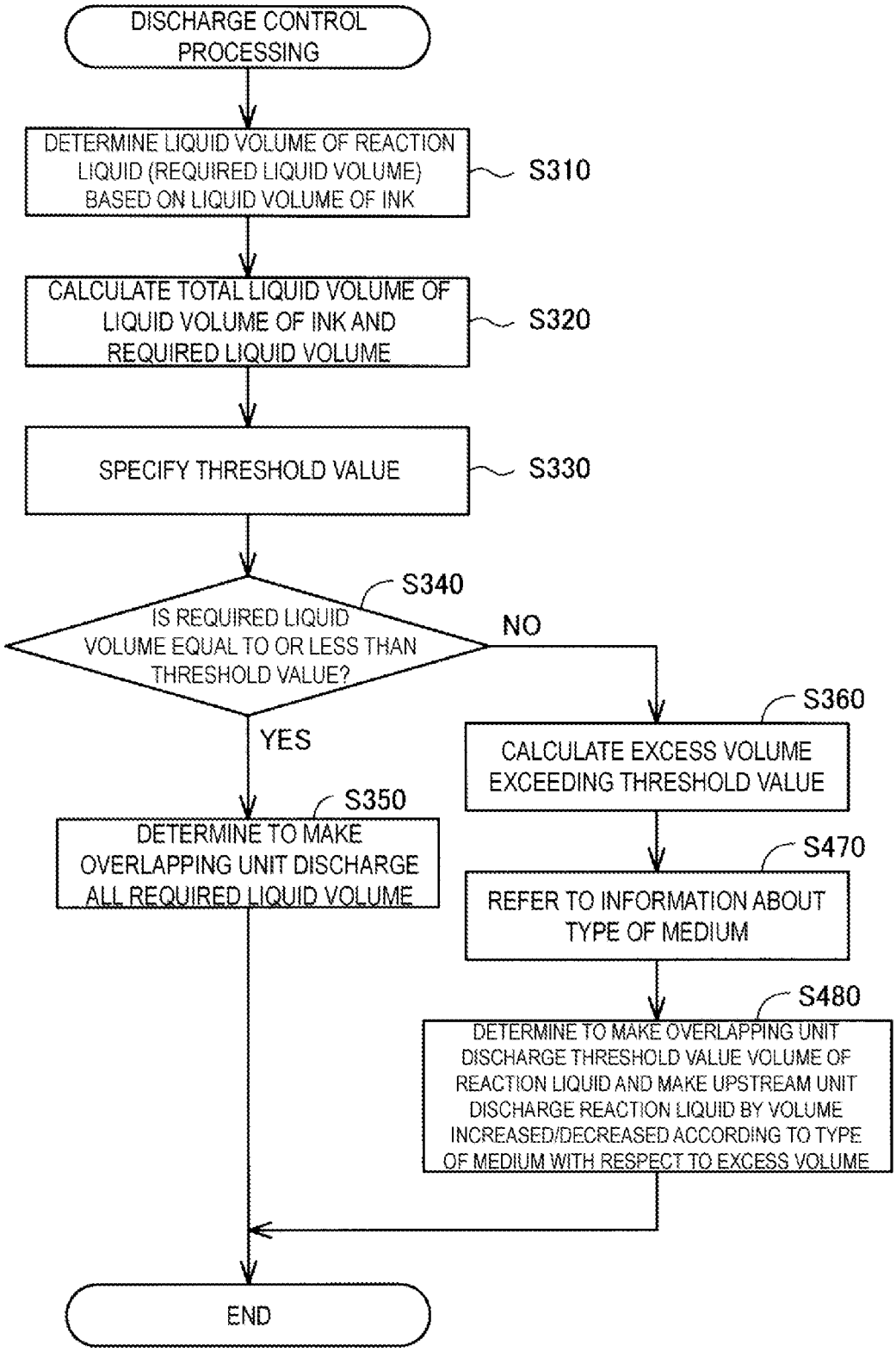
FIG. 7 is a flowchart illustrating a procedure of discharge control processing in a second exemplary embodiment.

FIG. 7 is a flowchart illustrating a procedure of discharge control processing in a second exemplary embodiment. The discharge control processing in the second exemplary embodiment differs from the discharge control processing in the first exemplary embodiment in that step S470 and step S480 are executed instead of step S370 illustrated in FIG. 5. Since the other configurations including the configuration of the printing apparatus 10 are identical to those in the first exemplary embodiment, the same configurations are assigned the same reference signs and detailed description of those configurations will be omitted.

In the discharge control processing in the second exemplary embodiment, after execution of step S360, a control section 97 refers to information about a type of a medium M acquired by a medium type acquisition unit 98 (step S470).

The control section 97 determines to make, of an overlapping unit 58 and an upstream unit 57 provided in a second nozzle group 56, the overlapping unit 58 discharge threshold value volume of a reaction liquid, and make the upstream unit 57 discharge liquid volume of the reaction liquid obtained by applying a coefficient according to the type of the medium M to excess volume (step S480). Such a coefficient may be stored in a memory 92 in advance, or may be calculated according to the type of the medium M. Additionally, the control section 97 may add such a coefficient to the excess volume, may subtract the coefficient from the excess volume, or may multiply the excess volume by the coefficient. That is, the control section 97 increases/decreases the liquid volume of the reaction liquid to be discharged from the upstream unit 57, with respect to the excess volume according to the type of the medium M to determine the liquid volume of the reaction liquid.

Figure 8:
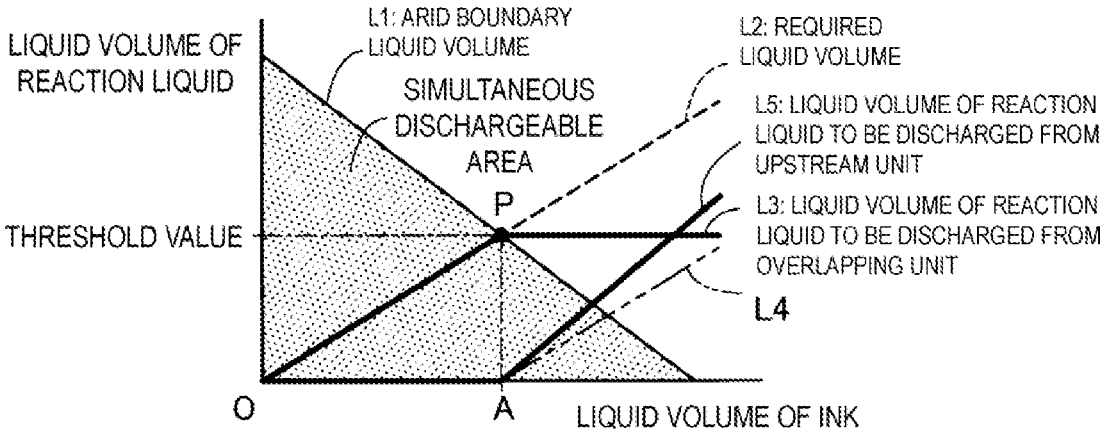
FIG. 8 is an explanatory view for explaining discharge control processing results in the second exemplary embodiment.

FIG. 8 is an explanatory view for explaining discharge control processing results in the second exemplary embodiment. In FIG. 8, the line L4 illustrated in FIG. 6 is denoted by a dashed-two dotted line for reference, and the liquid volume of the reaction liquid to be discharged from the upstream unit 57 is denoted by a solid line L5. As a result of the discharge control processing, when required liquid volume exceeds the threshold value, that is, when the liquid volume of the ink exceeds liquid volume A, the threshold value volume of the reaction liquid is discharged from the overlapping unit 58, and also the reaction liquid determined according to the type of the medium M is discharged from the upstream unit 57. In an example illustrated in FIG. 8, the liquid volume of the reaction liquid to be discharged from the upstream unit 57 is increased to be greater than the excess volume.

According to the discharge control processing in the above-described second exemplary embodiment, effects similar to the effects of the discharge control processing in the first exemplary embodiment can be provided. In addition, since the control section 97 determines the liquid volume of the reaction liquid to be discharged from the upstream unit 57 according to the type of the medium M, for example, the liquid volume of the reaction liquid can be increased with respect to the medium M having fast permeation speed, and the liquid volume of the reaction liquid can be decreased with respect to the medium M having slow permeation speed. Accordingly, printing can further be optimized with respect to various media. Additionally, as compared to an aspect in which a user selects to increase/decrease liquid volume of a reaction liquid, the operation by the user can be omitted.

C. Other Exemplary Embodiments (1) The configuration of the printing head 50 in each of the above-described exemplary embodiments is merely an example, and various changes can be applied. For example, each of the first nozzle group 51 and the second nozzle group 56 includes two nozzle chips arranged in the sub scanning direction Y, but may include any other number of nozzle chips, such as one and three or more. Additionally, for example, the overlapping unit 58 of the second nozzle group 56 may be disposed, as viewed in the main scanning direction X, to overlap over an entire length in the sub scanning direction Y of the first nozzle group 51. Additionally, for example, the second nozzle group 56 may further include the nozzle Nz disposed on a downstream side of the first nozzle group 51 in the sub scanning direction Y. Additionally, for example, the second nozzle group 56 may include a plurality of the nozzle rows, and may be configured to be capable of discharging a plurality of the reaction liquids. That is, in general, the second nozzle group 56 may include the upstream unit 57 disposed on the upstream side of the first nozzle group 51 in the sub scanning direction Y, and the overlapping unit 58 located on the downstream side of the upstream unit 57 in the sub scanning direction Y and disposed to overlap with at least a portion of the first nozzle group 51 as viewed in the main scanning direction X. According to such a configuration, effects similar to the effects in the exemplary embodiments described above are also provided.

(2) The discharge control processing in each of the above-described exemplary embodiments is merely an example, and various changes can be applied. For example, at step S310, the control section 97 determines the required liquid volume based on the liquid volume of the ink, but may calculate volume of the reaction liquid necessary for each ink color and total the volume to determine the required liquid volume. Additionally, for example, at step S350, the control section 97 may determine to make the upstream unit 57 discharge a portion of the required liquid volume, within the range in which the effects of the invention can be obtained. Additionally, for example, at step S370, within the range in which the effects of the invention can be obtained, the control section 97 may determine to decrease volume of the reaction liquid to be discharged from the overlapping unit 58 to be less than the threshold value volume, and may determine to make the upstream unit 57 discharge the decreased volume of the reaction liquid and the excess volume of the reaction liquid. Additionally, for example, in the second exemplary embodiment, the control section 97 increases/decreases the liquid volume of the reaction liquid to be discharged from the upstream unit 57 with respect to the excess volume according to the type of the medium M to determine the liquid volume of the reaction liquid, but an aspect in which a user selects to increase/decrease the liquid volume of the reaction liquid according to the type of the medium M, and based on the selected contents, the liquid volume of the reaction liquid to be discharged from the upstream unit 57 is increased/decreased may be adopted. According to such a configuration, effects similar to the effects in the exemplary embodiments described above are also provided.

(3) The printing processing in each of the above-described exemplary embodiments is executed by single pass printing in which discharging of ink in one raster is executed in one time of the main scanning, but may be executed by multi-pass printing in which discharging of the ink in one raster is executed in a plurality of times of the main scanning. According to such a configuration, effects similar to the effects in the exemplary embodiments described above are also provided.

(4) The configuration of the printing apparatus 10 in each of the above-described exemplary embodiments is merely an example, and various changes can be applied. For example, the sub scanning unit 40 is configured to transport the medium M wound in a roll shape, but may be configured to transport the medium M having a sheet shape. Additionally, for example, the sub scanning unit 40 is configured to transport the medium M from the upstream side to the downstream side in the sub scanning direction Y, but may be configured to move the printing head 50, instead of transporting the medium M, from the downstream side to the upstream side in the sub scanning direction Y. Additionally, for example, the main scanning unit 30 is configured to move the printing head 50 in the main scanning direction X, but may be configured to transport the medium M in the main scanning direction X, instead of moving the printing head 50. That is, in general, the printing apparatus 10 may include the sub scanning unit 40 configured to move the medium M relatively in the sub scanning direction Y with respect to the printing head 50, and may include the main scanning unit 30 configured to move the printing head 50 relatively in the main scanning direction X with respect to the medium M. Additionally, for example, an aspect in which the heating unit 60 of the printing apparatus 10 is omitted and the medium M is heated by a heating device provided outside the printing apparatus 10 may be adopted. Additionally, for example, the printing apparatus 10 may include the print control device 200. According to such a configuration effects similar to the effects in the exemplary embodiments described above are also provided.

(5) In the above-described exemplary embodiment, some of the configurations realized by hardware may be replaced with software, and conversely, some of the configurations realized by software may be replaced with hardware. Additionally, when some or all of the functions of the invention are realized by software, the software (computer program) can be provided in a form that the software is stored in a computer readable recording medium. In the invention, the "computer readable recording medium" is not limited to a portable recording medium such as a flexible disk, and a CD-ROM, and includes an internal storage device in a computer such as various types of RAMs and ROMs, and an external storage device fixed in a computer such as a hard disk. That is, the "computer readable recording medium" has a broad meaning including any recording medium in which data can be stored not temporarily but permanently.

The invention is not limited to the exemplary embodiments described above, and can be realized in various configurations without departing from the gist of the invention. For example, technical features in the exemplary embodiments corresponding to the technical features in the modes described in the summary of the invention can appropriately be replaced or combined to address some or all of the above-described issues or to achieve some or all of the above-described effects. Additionally, when the technical features are not described herein as essential technical features, such technical features may be deleted appropriately.

This application claims priority under 35 U.S.C. § 119 to Japanese Patent Application No. 2018-004691, filed Jan. 16, 2018. The entire disclosure of Japanese Patent Application No. 2018-004691 is hereby incorporated herein by reference.

What is claimed is:

1. A printing apparatus configured to print an image on a medium, the printing apparatus comprising:

a head including a first nozzle group configured to discharge a first liquid onto the medium, and a second nozzle group configured to discharge a second liquid acting on the first liquid;

a main scanning unit configured to relatively move the head in a main scanning direction with respect to the medium;

a sub scanning unit configured to relatively move the medium in a sub scanning direction intersecting with the main scanning direction with respect to the head; and a control section configured to control discharging of the first liquid from the first nozzle group and discharging of the second liquid from the second nozzle group, wherein the second nozzle group includes an upstream unit disposed on an upstream side of the first nozzle group in the sub scanning direction, and an overlapping unit located on a downstream side of the upstream unit in the sub scanning direction and disposed to overlap with at least a portion of the first nozzle group as viewed in the main scanning direction, the control section determines, based on liquid volume of the first liquid to be discharged, liquid volume of the second liquid to be discharged, and in a case where the liquid volume determined of the second liquid is equal to or less than a threshold value, the control section makes, of the overlapping unit and the upstream unit, at least the overlapping unit discharge the second liquid.

2. The printing apparatus according to claim 1, wherein in a case where the liquid volume determined of the second liquid exceeds the threshold value, the control section makes both the overlapping unit and the upstream unit discharge the second liquid.

3. The printing apparatus according to claim 2, wherein the control section includes a medium type acquisition unit configured to acquire information about a type of the medium, and determines liquid volume of the second liquid to be discharged from the upstream unit, according to a type of the medium.

4. The printing apparatus according to claim 1, wherein the threshold value is set for each of a plurality of print modes different in printing quality from one another.

5. A printing method of printing an image on a medium by using a printing apparatus including a head including a first nozzle group configured to discharge a first liquid, and a second nozzle group configured to discharge a second liquid acting on the first liquid, and relatively moving in a main scanning direction with respect to the medium, and by relatively moving the medium in a sub scanning direction intersecting the main scanning direction with respect to the head, the method comprising:

determining liquid volume of the second liquid to be discharged, based on liquid volume of the first liquid to be discharged; and in a case where the liquid volume determined of the second liquid is equal to or less than a threshold value, making, of an upstream unit provided in the second nozzle group, and disposed on an upstream side of the first nozzle group in the sub scanning direction, and an overlapping unit provided in the second nozzle group, located on a downstream side of the upstream unit in the sub scanning direction and overlapping with at least a portion of the first nozzle group as viewed in the main scanning direction, at least the overlapping unit discharge the second liquid.

* * * * *